United States Patent [19]

Noble

[11] 4,145,141

[45] Mar. 20, 1979

[54] OPTICAL INSTRUMENT FOR SETTING THE POSITION OF A FILAMENT OF A SIGNAL LAMP

[75] Inventor: Peter M. Noble, Valencia, Pa.

[73] Assignee: Westinghouse Air Brake Company, Swissvale, Pa.

[21] Appl. No.: 770,644

[22] Filed: Feb. 22, 1977

[51] Int. Cl.[2] ..... F21V 19/02

[52] U.S. Cl. ..... 356/123; 316/23; 356/255; 362/285

[58] Field of Search ..... 356/123–127, 356/252, 255; 316/23, 29; 33/297–298, 264, 288; 343/703; 313/146; 362/285–289, 429

[56] References Cited

U.S. PATENT DOCUMENTS

| | | | |
|---|---|---|---|
| 2,002,477 | 5/1935 | Merkel | 356/123 |
| 2,520,866 | 8/1950 | Wells | 356/123 |
| 3,418,052 | 12/1968 | Hoffman | 356/123 |

*Primary Examiner*—John K. Corbin
*Assistant Examiner*—Wm. H. Punter
*Attorney, Agent, or Firm*—J. B. Sotak; R. W. McIntire, Jr.

[57] ABSTRACT

An optical instrument for locating the focal point of a smooth surface concave reflector of a signal lamp unit. The optical instrument includes a cylindrical metallic base member for insertion into the electrical socket of a light bulb. A translucent sighting target member is carried by the base member and includes a reticle for focusing in a distant image whereby the filament of a light bulb will be located at the focal point of the concave reflector for maximizing the illuminative efficiency of the signal lamp unit.

4 Claims, 3 Drawing Figures

Fig. 1
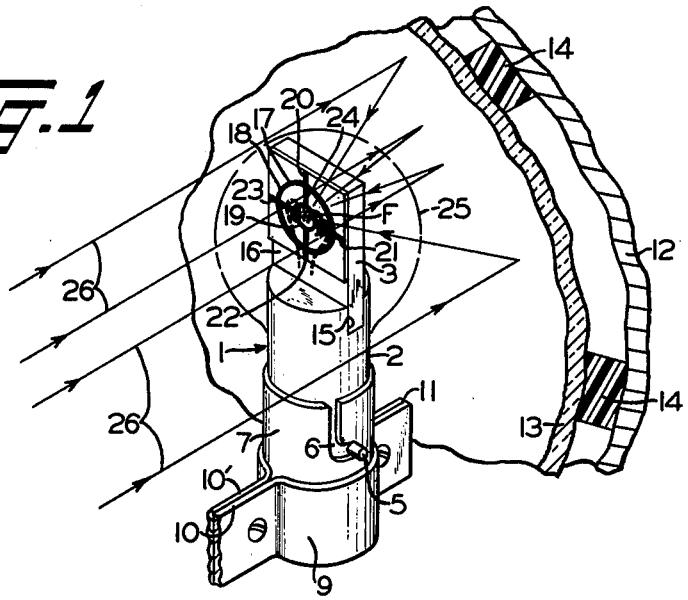
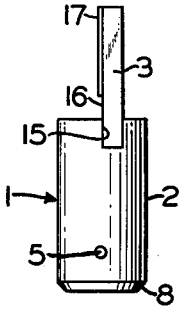
Fig. 2
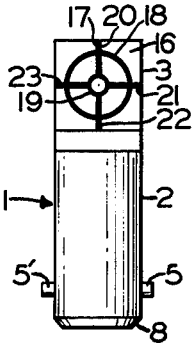
Fig. 3

OPTICAL INSTRUMENT FOR SETTING THE POSITION OF A FILAMENT OF A SIGNAL LAMP

FIELD OF THE INVENTION

This invention relates to a filament positioning device for signal lamps and, more particularly, to an optical instrument having a base for placement into an adjustable socket for a light bulb and having a translucent sight provided with a reticle for establishing the focal point of a smooth surface concave mirror so that the filament of the light bulb is located at the focal point when the optical instrument is replaced by the light bulb.

BACKGROUND OF THE INVENTION

In certain signal lamp installations, such as, in railroad-highway crossing warning apparatus, flashing lights are used to visually forewarn oncoming motorists and pedestrians of approaching trains and transit vehicles. In typical highway crossing signal lamp units, an incandescent light bulb having a concentrated filament is used in combination with an adjustable socket bracket, a parabolic reflective mirror and a colored lens to project the parallel light rays in a predetermined direction. In order to maximize the effectiveness of the parabolic reflector, it is essential that the light emitting filament of the incandescent bulb must be located at the focal point of the parabola. Thus, the impinging light rays are reflected in a parallel direction from the surface of the parabolic mirror so that a highly concentrated light source is viewed by the distant motorists in plenty of time to stop their vehicles as they approach the highway crossing. Thus, focusing of the light bulb allows the motorists to be alerted at a greater distance from the crossing than if the filament was not situated at the focal point of the parabolic reflective mirror. In the past, it was common practice to employ integral sighting devices or finders to determine when the filament of the lamp was located at the focal point of the concave mirror. It will be appreciated that such an integral sighting device, which included a sight tube carrying a lens and a ground glass plate having cross-hairs upon which an image of the filament was focused, not only increases the basic cost of each individual signal lamp but also increases the weight and bulkiness of the lamp unit. In addition, there were other previous types of non-integral focusing devices, which could be repeatedly used on and transferred from one signal lamp to another. However, these detachable finders were highly complex and were usually designed for only one specific model or type of signal lamp. Thus, while these prior art types of focal finders were successfully used in the past for setting the position of a filament of a lamp at the focal point of the lens or reflector, they were relatively expensive to manufacture, and those specifically constructed devices have limited usage in only one or a given model of signal lamp.

OBJECTS OF THE INVENTION

Accordingly, it is an object of this invention to provide a unique focal point optical instrument which has wide usage.

A further object of this invention is to provide a simple lamp filament positioning device for locating the focal point of a concave reflector.

Another object of this invention is to provide a new and improved optical instrument for locating a filament of a light bulb at the focal point of a parabolic mirror.

Still a further object of this invention is to provide a novel lamp filament locating device which fits into the socket of the lamp for establishing the focal point of a smooth surface reflector.

Still a further object of this invention is to provide an improved focal point finding device for signal lamps.

Yet another object of this invention is to provide a unique lamp filament positioning device having a base for placement into a lamp socket and having a translucent plate carrying a reticle for locating the focal point of a concave mirror.

Yet a further object of this invention is to provide a novel optical instrument having a base portion for insertion into a lamp socket and a reticle portion for imaging an object reflected by the surface of a parabolic mirror.

An additional object of this invention is to provide a new lamp filament positioning device having a base adapted to be placed into a lamp socket and having a sight means attached to the base for establishing the focal point of a smooth surface reflector for maximizing the illuminative efficiency of a lamp.

Yet an additional object of this invention is to provide a new optical instrument for locating the position of the filament of a light bulb at the focal point of a concave reflector in a signal lamp having a first means for insertion into the socket for a light bulb and having second means carried by the first means for sighting in the focal point of the concave reflector so that the filament of the lamp is located at the focal point when the base of the light bulb is inserted into the socket.

SUMMARY OF THE INVENTION

In general, this invention relates to an optical instrument for locating and positioning the filament of a light bulb at the focal point of a smooth surface parabolic mirror in a signal lamp. The optical instrument includes a cylindrical base member having a pair of diametrically opposed lateral ears located near the lower end for insertion into a bayonet type of light bulb socket. The upper end of the cylindrical base member includes a rectangular slot formed in the top surface for accommodating the lower end of rectangular target member which is glued in place. The body of the target member is constructed of clear plastic material in which the front surface has frosted finish. An adhesive film having a reticle in the form of circular and quadrant markings is stuck to the front surface of the plastic body for establishing the focal point of the parabolic reflector mirror by imaging a distant object on the reflective surface of the mirror whereby the illuminative efficiency of the light bulb is maximized when the signal lamp is turned on for signaling purposes.

DESCRIPTION OF THE DRAWINGS

The foregoing objects and other attendant features and advantages will be more readily appreciated as the subject invention becomes more clearly understood by reference to the following detailed description when considered in conjunction with the accompanying drawings wherein:

FIG. 1 is a fragmentary prospective view of a signal lamp employing the optical instrument for locating the filament of a light bulb at the focal point of a parabolic reflector.

FIG. 2 is a side elevational view of the optical instrument of the present invention.

FIG. 3 is a front elevational view of the optical sighting instrument.

DETAILED DESCRIPTION OF THE INVENTION

Referring now to the drawings, and in particular to FIG. 1, there is shown a partial signal lamp unit with the front cover which carries the lens, the hood and the background removed, and with the back housing, parabolic mirror and the light bulb bracket broken away. As shown in the optical instrument embodying the present invention is generally characterized by numeral 1 and includes a base member 2 and a sight or target member 3. In practice, the base member 2 includes a cylindrical body preferably constructed of metal, such as, brass or the like. It will be noted that a pair of diametrically opposed rod ends or ears 5 and 5' which are adapted to slide into a respective slot formed on opposite sides, as shown by numeral 6, of a conventional bayonet type of socket 7. As shown, in FIGS. 2 and 3, the lower peripheral end 8 of metallic base 2 is slightly tapered to facilitate insertion into the electrical bayonet socket 7. The cylindrical socket 7 is mounted within the tubular portion 9 formed by a pair of band or strap members 10 and 10' of a bracket 11 which is located within the signal lamp unit. The lamp unit includes a cast metallic housing having a back case member 12 partially shown in FIG. 1. A parabolic reflector or smooth surface concave mirror 13 is resiliently mounted by rubber strips 14 which are glued to the inner surface of case 12 as well as to the back surface of mirror 13. In viewing FIGS. 1 and 2, it will be seen that the upper end of the base member 2 is provided with a rectangular slot 15 which extends across the top and is slightly off-centered from the diametrical cord. As shown, the lower end of the target member 3 is fitted into slot 15 and is glued in place with a suitable adhesive material, such as, anaerobic glue or the like. The target 3 includes a rectangular clear plastic body which has its front surface 16 roughened or sand blasted to produce a frosted effect. A reticle 17 which is made of photographic film is cemented to the frosted surface 16 of the rectangular target 3. The photographic film reticle includes a pair of concentric circles 18 and 19 and linear quadrant lines 21–23. In practice, the circles 18, 19 and lines 21–23 are utilized to simulate the position of the filament 24 of a light bulb 25 as shown in phantom in FIG. 1. It will be seen that when the reticle is located at the focal point F of the parabolic mirror 13, the light rays 26 from a distant object are imaged on the center of the target 3. Thus, after the focusing of the image, the optical instrument 1 is quickly and easily removed and a light bulb 25 is readily inserted into the bayonet socket 7 by a workman. Accordingly, the filament element 24 of the bulb 25 is exactly located at the focal point of the concave reflector 13 so the illuminative efficiency of the signal lamp unit is maximized to most effectively utilize light-emitting qualities of incandescent bulb 25.

After the light bulb 25 has been inserted, the front cover including the lens, hood and background may be placed over the open face of case 12 and secured in position to form a complete unit. After the unit has been completely assembled, the signal lamp may be mounted on a cross arm carried by a mast or pole positioned along-side of a highway of a railroad grade crossing installation to forewarn motorists and pedestrains of oncoming trains and/or transit vehicles.

It will be appreciated that the presently described optical-sighting instrument may be used to locate or find the focal point of other types of concave mirrors, such as spherical, elliptical or other shaped reflectors.

Further, it will be seen that the present invention results in an improved optical instrument for quickly and easily establishing the focal point of a smooth surface concave mirror of signal lamp units.

In addition, it is understood that various changes, modifications and alterations may be made by persons skilled in the art without departing from the spirit and scope of the present invention. For example, it will be appreciated that the base member 2 may take the form of a miniature or candalabra screw or a midget flanged to correspond to the type of socket employed in a particular lamp unit rather than a candelabra bayonet socket as shown. Further, the shape of the target member 2 may be varied, and the circular and linear markings of the reticle may be changed and varied in accordance with the type and size of the filament element of the light bulb. While the invention has been illustrated and described with reference to a preferred construction and arrangement, it is understood that the disclosed embodiment is susceptible to various adaptations and variations without departing from the spirit and scope of the invention and therefore such changes, modifications and equivalent are herein meant to be encompassed within the scope of the appended claims.

Having now described the invention, what I claim as new and desire to secure by Letters Patent, is:

1. A lamp filament positioning device comprising, a base adapted to be placed into a lamp socket, and a sight means attached to said base for establishing the focal point of a smooth surface reflector and a lamp having a filament and a base adapted to be situated in the lamp socket in place of the filament positioning device so that the filament is located at the focal point of the smooth surface reflector for maximizing the illuminative efficiency of the lamp, and said sight means includes cross marks for focusing onto the surface of the smooth surface reflector.

2. A lamp filament positioning device comprising, a base adapted to be placed into a lamp socket, and a sight means attached to said base for establishing the focal point of a smooth surface reflector and a lamp having a filament and a base adapted to be situated in the lamp socket in place of the filament positioning device so that the filament is located at the focal point of the smooth surface reflector for maximizing the illuminative efficiency of the lamp, and said sight means includes a translucent member having cross-mark target for imaging onto the reflective surface of the smooth surface reflector.

3. A lamp filament positioning device comprising, a base adapted to be placed into a lamp socket, and a sight means attached to said base for establishing the focal point of a smooth surface reflector and a lamp having a filament and a base adapted to be siturated in the lamp socket in place of the filament positioning device so that the filament is located at the focal point of the smooth surface reflector for maximizing the illuminative efficiency of the lamp, and said sight means includes a rectangular plastic member having a frosted surface.

4. A lamp filament positioning device comprising, a base adapted to be placed into a lamp socket, and a sight means attached to said base for establishing the focal point of a smooth surface reflector and a lamp having a filament and a base adapted to be situated in the lamp socket in place of the filament positioning device so that the filament is located at the focal point of the smooth surface reflector for maximizing the illuminative efficiency of the lamp, and said base is a cylindrical body having a slot formed in one end thereof for receiving said sight means which is a rectangular member having opaque markings located on one side thereof.

* * * * *